US005731534A

United States Patent [19]

Tamura et al.

[11] Patent Number: 5,731,534

[45] Date of Patent: Mar. 24, 1998

[54] METHOD AND APPARATUS FOR IMPARTING AN EFFECT TO A TONE SIGNAL WITH GRADE DESIGNATION

[75] Inventors: Motoichi Tamura; Hiroyuki Sato, both of Hamamatsu, Japan

[73] Assignee: Yamaha Corporation, Japan

[21] Appl. No.: 716,553

[22] Filed: Sep. 18, 1996

[30] Foreign Application Priority Data

Sep. 22, 1995 [JP] Japan ..... 7-269193
Nov. 10, 1995 [JP] Japan ..... 7-293054

[51] Int. Cl.[6] ..... G10H 1/02

[52] U.S. Cl. ..... 84/662; 84/665

[58] Field of Search ..... 84/600, 626, 633, 84/662, 665

[56] References Cited

U.S. PATENT DOCUMENTS 4,731,835 3/1988 Futamase et al. .
5,319,151 6/1994 Shiba et al. .
5,410,603 4/1995 Ishiguro et al. ..... 84/626 X
5,420,374 5/1995 Hotta ..... 84/622
5,473,107 12/1995 Mizuno ..... 84/626 X
5,554,814 9/1996 Nakata ..... 84/659
5,596,159 1/1997 O'Connell ..... 84/630

*Primary Examiner*—William M. Shoop, Jr.
*Assistant Examiner*—Jeffrey W. Donels
*Attorney, Agent, or Firm*—Graham & James LLP

[57] ABSTRACT

An effect imparting processing and other processing are executed by shared use of a same microprocessor. When the other processing involves a relatively great amount of calculation, the effect imparting processing is set to a lower grade to reduce the amount of calculation necessary for the effect imparting processing, so that more computing capability of the microprocessor can be allocated to the other processing. When the other processing involves a relatively small amount of calculation, the effect imparting processing is set to a higher grade to impart a higher-quality effect to a tone signal. In an effect imparting device, the level of the input audio signal is monitored and execution of the effect imparting processing is discontiued when supply of the audio signals is stopped continuously for a predetermined time period. Thereafter, the effect imparting processing is resumed when the supply of the audio signal is restarted.

19 Claims, 12 Drawing Sheets

| BUFFER XL |
|---|
| 1ST SAMPLE OF WAVEFORM DATA |
| 2ND SAMPLE OF WAVEFORM DATA |
| 3RD SAMPLE OF WAVEFORM DATA |
| ⋮ |
| 128TH SAMPLE OF WAVEFORM DATA |

| BUFFER XR |
|---|
| 1ST SAMPLE OF WAVEFORM DATA |
| 2ND SAMPLE OF WAVEFORM DATA |
| 3RD SAMPLE OF WAVEFORM DATA |
| ⋮ |
| 128TH SAMPLE OF WAVEFORM DATA |

| BUFFER XX |
|---|
| 1ST SAMPLE OF WAVEFORM DATA |
| 2ND SAMPLE OF WAVEFORM DATA |
| 3RD SAMPLE OF WAVEFORM DATA |
| ⋮ |
| 128TH SAMPLE OF WAVEFORM DATA |

METHOD AND APPARATUS FOR IMPARTING AN EFFECT TO A TONE SIGNAL WITH GRADE DESIGNATION

BACKGROUND OF THE INVENTION

The present invention relates generally to a tone processing method and device which generally belong to a technical field of imparting effects to tone signals, and more particularly to a technique which permits an efficient distribution of microprocessor resources when a same microprocessor executes effect imparting processing and other processing.

The present invention further relates to an effect imparting device which includes a computer such as a personal computer and imparts various tonal effects, such as reverberation, chorus and distortion, to audio signals through arithmetic operations performed by the computer.

In many known electronic musical instruments, there is employed a microprocessor, such as a DSP (digital signal processor), which executes effect imparting processing to impart predetermined or desired effects (e.g., delay-based effects such as reverberation) to tone signals. U.S. Pat. No. 4,731,835 discloses an effect imparting technique using a DSP.

If the microprocessor is designed to execute no other processing than the effect imparting processing, then all the microprocessor resources can be used exclusively for the effect imparting processing. However, in cases where the microprocessor is designed to execute the effect imparting processing in parallel with other processing (e.g., a tone generating processing) or to execute the effect imparting processing time-divisionally with other processing within a predetermined time period, the total amount of calculation necessary for the effect imparting processing and other processing would exceed the limited computing capability of the microprocessor, or the total amount of calculation would fall far below the microprocessor's computing capability so that the computing capability could not be fully utilized, due to the fact that the amount of calculation necessary for the other processing significantly increases or decreases over time. U.S. Pat. No. 5,319,151 dicloses a technique for producing a tone signal by executing a predetermined computer program of tone generating processing.

Further, owing to the high-performance personal computers available today, more sophisticated electronic musical instruments have been developed, which are capable of executing tone synthesis or effect imparting processing through arithmetic operations by a CPU of the computer. Many of the instruments are equipped with a function to execute effect imparting processing on audio signals and other application software in a parallel fashion.

Generally, the effect imparting processing to impart a reverberation effect or the like involves a relatively great amount of calculation using a considerable part of the limited computing capability of the personal computer, which would often prevent the other application software from being executed properly without interference from the effect imparting processing. Further, although the effect imparting processing for a reverberation effect or the like should be continually executed as long as audio signals to be processed are supplied or input, it need not be executed when there is no audio signal input. However, because the above-discussed conventionally known electronic musical instruments are designed to execute the effect imparting processing continually irrespective of presence/absence of audio signal input, arithmetic operations are performed wastefully even during a period when there is no audio signal input, and such wasteful arithmetic operations would undesirably prevent proper execution of other application software.

SUMMARY OF THE INVENTION

It is therefore an object of the present invention to provide a tone processing method and device which permit an efficient distribution of microprocessor resources in cases where effect imparting processing to impart an effect to a tone signal and other processing are executed by a same microprocessor.

It is another object of the present invention to provide an effect imparting device which is capable of efficiently executing effect imparting processing on an audio signal without wasting the computing capability of a microprocessor.

In order to accomplish the above-mentioned objects, a tone processing method according to a first aspect of the present invention executes effect imparting processing to impart an effect to a supplied tone signal and other processing by shared use of a same microprocessor, and is characterized in that it comprises a first step of controlling contents of the effect imparting processing depending on an amount of calculation necessary for the other processing, and a second step of executing the effect imparting processing on the supplied tone signal in accordance with the contents controlled in the first step.

A tone generating device according to a first aspect of the present invention comprises a processor section for executing effect imparting processing to impart an effect to a supplied tone signal and other processing by shared use of a same microprocessor, and a control section for controlling contents of the effect imparting processing depending on an amount of calculation necessary for the other processing.

According to the first aspect of the invention, as the amount of calculation necessary for the other processing varies over time, the contents of the effect imparting processing is controlled depending on the amount of calculation necessary for the other processing, and the effect imparting processing is executed in accordance with the thus-controlled contents. Namely, when the other processing involves a relatively great amount of calculation, the effect imparting processing is set to a lower grade to reduce the amount of calculation necessary for the effect imparting processing, so that more computing capability of the microprocessor can be allocated to the other processing. Conversely, when the other application processing involves a relatively small amount of calculation, the effect imparting processing is set to a higher grade to allow a higher-quality effect to be imparted a tone signal. This arrangement permits an efficient distribution of the microprocessor resources in executing the effect imparting processing and other processing by shared use of the same microprocessor.

A tone processing method according to a second aspect of the present invention executes effect imparting processing to impart an effect to a supplied tone signal and other processing by shared use of a same microprocessor, and is characterized in that it comprises a first step of selectively designating a grade of the effect imparting processing, and a second step of executing the effect imparting processing on the supplied tone signal in accordance with contents corresponding to the grade designated in the first step.

A tone generating device according to a second aspect of the present invention comprises a processor section for executing effect imparting processing to impart an effect to a supplied tone signal and other processing by shared use of a same microprocessor, and an operator section for selectively designating a grade of the effect imparting processing, the processor section executing the effect imparting processing on the supplied tone signal in accordance with contents corresponding to the grade designated by the operator section.

According to the second aspect, when a player selectively designate a grade of the effect imparting processing, the processing is executed in accordance with contents corresponding to the designated grade. Thus, this arrangement permits an efficient distribution of the microprocessor resources as in the first-aspect method and device, by the player designating a grade depending on the amount of calculation necessary for the other processing or by the user adjusting at desired timing while actually listening to an effect-imparted generated tone.

A tone processing method according to a third aspect of the present invention executes effect imparting processing to impart an effect to a supplied tone signal and other processing by shared use of a same microprocessor, and is characterized in that it comprises a first step of detecting a tone volume level of the supplied tone signal, and a second step of executing the effect imparting processing on the tone signal when the tone volume level detected in the first step is equal to or higher than a predetermined value but omitting execution of the effect imparting processing on the tone signal when the tone volume level detected in the first step is lower than the predetermined value.

A tone processing device according to a third aspect of the present invention comprises a detecting section for detecting a tone volume level of a supplied tone signal, a processor section for executing effect imparting processing to impart an effect to the supplied tone signal and other processing, and an instructing section for instructing the processor section to omit execution of the effect imparting processing when the tone volume level detected by the detecting section is lower than a predetermined value.

According to the third aspect, a tone volume level of each supplied tone signal is detected, and when the detected tone volume level is lower than the predetermined value, execution of the effect imparting processing on the signal is omitted. Thus, when the volume level is below the predetermined value such as when no tone is being sounded, the entire computing capability of the microprocessor can be allocated to the other processing without wasting the computing capability in the effect imparting processing. Thus, this arrangement also achieves an efficient distribution of the microprocessor resources.

Further, the present invention provides an effect imparting device wich comprises a calculating section for performing various arithmetic operations, said calculation section performing an operation for execution of effect imparting processing to impart a predetermined effect to an audio signal, and a control section for discontinuing the execution of the effect imparting processing when supply of the audio signal is stopped continuously for a predetermined time period and resuming the execution of the effect imparting processing when the supply of the audio signal is restarted.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

The present invention will be described hereinbelow in relation to a case where hardware tone generating LSI and DSP are replaced by computer programs describing tone generating processing and effect imparting processing which are both run by a single CPU (central processing unit). In the following description, systems for such tone generating processing and effect imparting processing will be collectively called hereinafter a CPU tone generator or software tone generator.

Figure 1:
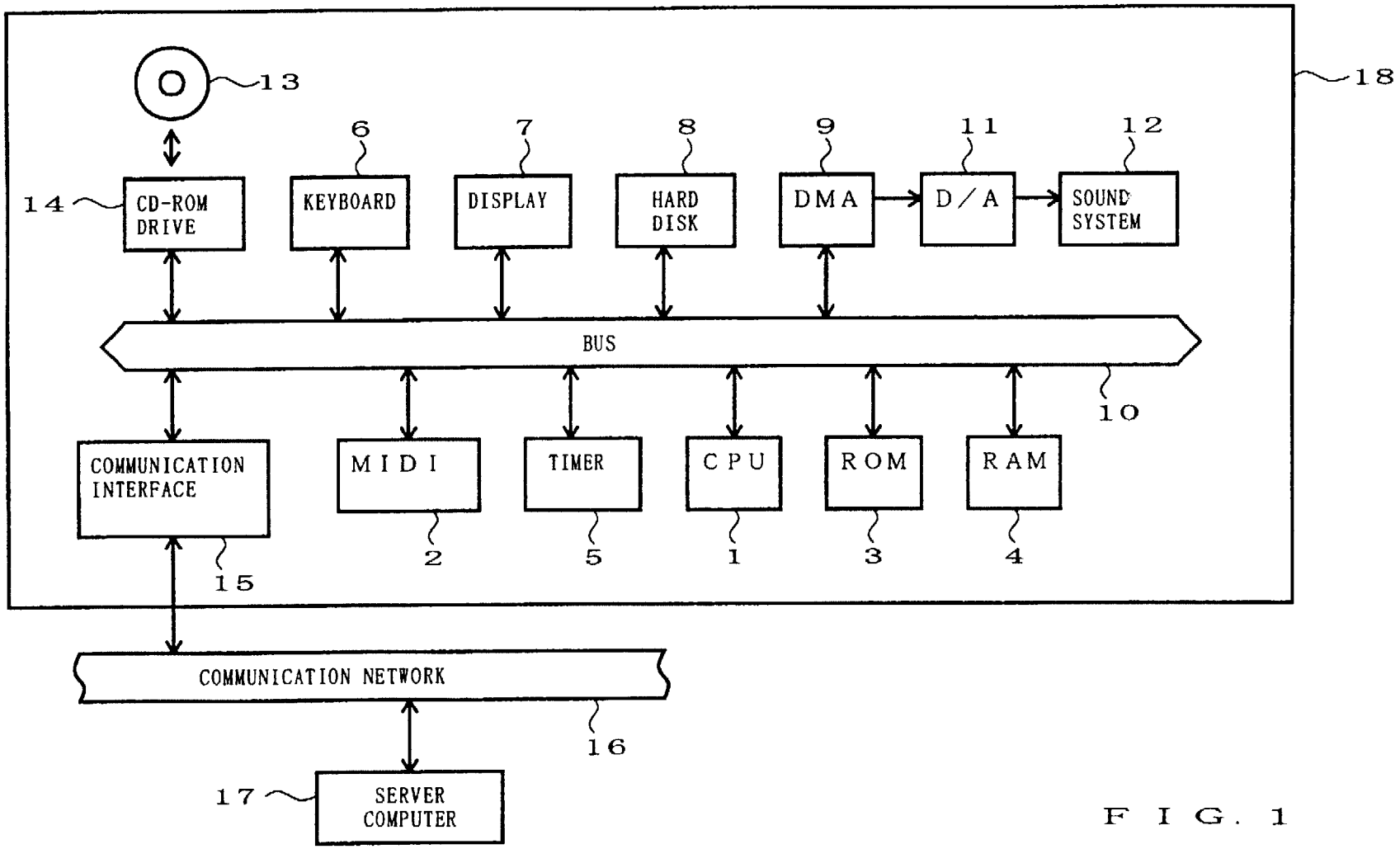
FIG. 1 is a block diagram illustrating a general structure of an electronic musical instrument employing a software tone generator in accordance with the present invention.

FIG. 1 is a block diagram illustrating a general structure of an electronic musical instrument 18 including the software tone generator to which is applied the principle of the present invention. The electronic musical instrument 18 is a music system based for example on a personal computer. On the basis of MIDI (Musical Instrument Digital Interface) performance information supplied from another MIDI musical instrument (not shown) in response to a player's performance operation, the electronic musical instrument 18 causes a CPU 1 of the personal computer to execute tone generating processing (i.e., processing to generate tone waveform data having tonal characteristics, such as pitch and color, as indicated by the MIDI performance information), as well as effect processing (i.e., processing to impart an effect to a tone as indicated by MIDI performance information or player's selection on an operation panel).

To the CPU 1 are connected, via a data and address bus 10, a MIDI interface 2 for coupling to another MIDI musical instrument, a ROM (read-only memory) 3, a RAM (random-access memory) 4, a timer 5, a keyboard 6, a display 7, a hard disk device 8 and a DMA (direct memory access) circuit 9.

The hard disk device 8 has prestored thereon tone color data (e.g., waveform data recorded using the PCM technique) that are read out in response to performance information for necessary processing. The RAM 4 has storage areas for temporarily storing tone signals having been generated and imparted effects.

The DMA circuit 9 executes a reproduction process based on the known direct memory access method, in which it sequentially reads out from the RAM 4 tone signals, one by one, in accordance with a reproduction sampling frequency (e.g., 48 kHz) of a D/A (digital-to-analog) converter 11 and transfers the read-out data to the D/A converter 11. As an example, the DMA circuit 9 executes this reproduction process on 128 samples of the tone signals as a single processed unit, and the DMA circuit 9 sets a predetermined time-shift flag each time it initiates the reproduction process on a single unit of the tone signals. Each tone signal converted via the D/A converter 11 into analog representation is audibly reproduced via a sound system 12 comprised of amplifiers and speakers.

In the hard disk 8, there may be stored various other data than the waveform data, such as automatic performance data and chord progression data and the above-mentioned operating program. By prestoring the operating program in the hard disk 8 rather than in the ROM 3 and loading the operating program into the RAM 4, the CPU 1 can operate in exactly the same way as where the operating program is stored in the ROM 3. This greatly facilitates version-up of the operation program, addition of an operating program, etc. A CD-ROM (compact disk) 13 may be used as a removably-attachable external recording medium for recording various data such as automatic performance data, chord progression data and tone waveform data and an optional operating program. Such an operating program and data stored in the CD-ROM 13 can be read out by a CD-ROM drive 14 to be transferred for storage into the hard disk 8. This facilitates installation and version-up of the operating program. The removably-attachable external recording medium may be other than the CD-ROM, such as a floppy disk and magneto optical disk (MO).

A communication interface 15 may be connected to a bus 10 so that the electronic musical instrument 18 can be connected via the interface 15 to a communication network 16 such as a LAN (local area network), internet and telephone line network and can also be connected to an appropriate sever computer 17 via the communication network 16. Thus, where the operating program and various data are not contained in the hard disk 8, these operating program and data can be received from the server computer 17 and downloaded into the hard disk 8. In such a case, the electronic musical instrument 18, a "client", sends a command requesting the server computer 17 to download the operating program and various data by way of the communication interface 15 and communication network 16. In response to the command, the server computer 17 delivers the requested operating program and data to the electronic musical instrument 18 via the communication network 16. The electronic musical instrument 18 completes the necessary downloading by receiving the operating program and data via the communication network 15 and storing these into the hard disk 8.

It should be understood here that the electronic musical instrument 18 may be implemented by installing the operating program and various data corresponding to the present invention in a commercially available personal computer. In such a case, the operating program and various data corresponding to the present invention may be provided to users in a recorded form on a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

Figure 2:
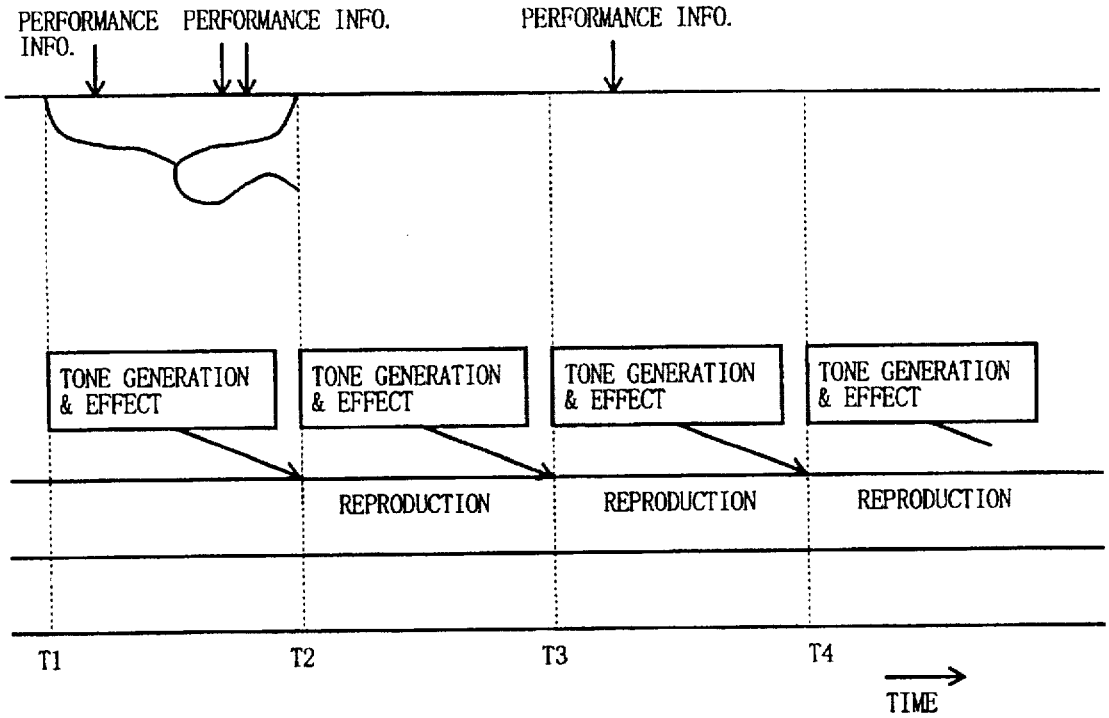
FIG. 2 is a diagram illustrating a basic functional principle of the software tone generator of FIG. 1.

FIG. 2 is a diagram illustrating a basic functional principle of the software tone generator. The tone generating processing and effect imparting processing are executed by the CPU 1 in each time section having a predetermined time length; more specifically, on the basis of performance information input via the MIDI interface 2 in each time section, the CPU 1 executes the tone generating processing in a plurality of tone generating channels corresponding to the number of tones to be simultaneously generated and the effect imparting processing on the generated tone signals in the next time section (immediately following the current time section). The tone signals thus generated and imparted effect in each time section are reproduced by the DMA circuit 9 in the next time section; in the example of FIG. 2, the tone generating processing is first executed by the CPU 1 in a time section from time T2 to time T3 on the basis of performance information input in a time section from time T1 to time T2, and the reproduction process is executed on the generated tone signals by the DMA circuit 9 in the next time section from time T3 to time T4. Thus, the length of each of the time sections is equal to the product between the number of samples reproduced at one time by the DMA circuit 9 and the reproduction sampling period, which in the example of FIG. 2 is about 0.0027 sec (128÷48,000).

Because the reproduction process has to be conducted successively throughout the time sections in order to generate a tone without a break, 128 samples of tone signals to be reproduced in each of the time sections by the DMA circuit 9 must have already been processed completely by the tone generating and effect imparting processing in the preceding time section. However, the amount of calculation necessary for the tone generating processing will greatly differ among the time sections, for example, due to the fact that the number of tone generating channels to be used varies over time depending on input performance information. In contrast, the amount of calculation necessary for the effect imparting processing will not differ among the time sections due to the number of tone generating channels to be used, because the effect imparting processing is performed on signals obtained by accumulating the signals generated in the individual tone generating channels.

Also, the CPU 1 has to execute these processing in the software tone generator in parallel with processing of other application software on a multitask basis.

The foregoing is the basic functional principle of the software tone generator, but it should be appreciated that the operation timing of the software tone generator need not be strictly as illustrated in FIG. 2. For instance, the tone generating and effect imparting processing based on performance information input within a predetermined number of successive time sections may be executed collectively in a single time section. Further, the value of the "predetermined number" may be varied with the passage of time.

The electronic musical instrument 18 employing the software tone generator controls contents of the effect imparting processing depending on the amounts of calculation necessary for the other application software processing and the tone generating processing, so as to efficiently execute the tone generating and effect imparting processing in the software tone generator while achieving an efficient distribution of the CPU resources.

A description will now be made about an example of the tone generating processing with reference to FIG. 3 and other figures following FIG. 3.

Figure 3:
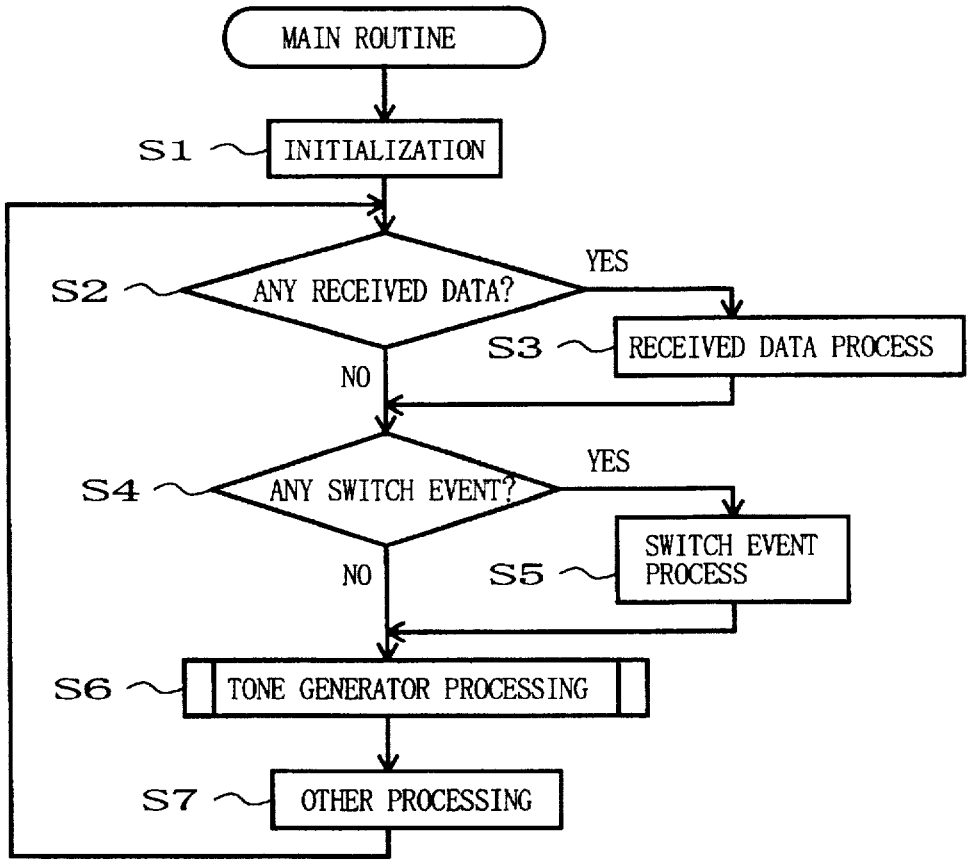
FIG. 3 is a flowchart of a main routine executed by a CPU of FIG. 1.

FIG. 3 is a flowchart of a main routine executed by the CPU 1. In this main routine, after a predetermined initializing process at step S1, a determination is made at step S2 as to whether received data are stored in an input buffer within the RAM 4. With an affirmative determination at step S2, the CPU 1 executes a received data process at step S3, which includes, for example, note-on and note-off event processes based on note-on and note-off event signals supplied via the MIDI interface 2.

Then, a determination is made at step S4 as to whether there is an operation event of any of various switches provided on the keyboard 6. If there is such an operation event as determined at step S4, the CPU 1 executes a switch event process at step S5, which includes, for example, a tone color selecting operation based on activation of a tone color selecting switch and an effect type selecting operation based on activation of an effect selecting switch. Then, the CPU 1 executes tone generator processing at step S6 and other processing at step S7. Thereafter, the CPU 1 repetitively executes the operations of steps S2 to S7 in a steady loop.

Figure 4:
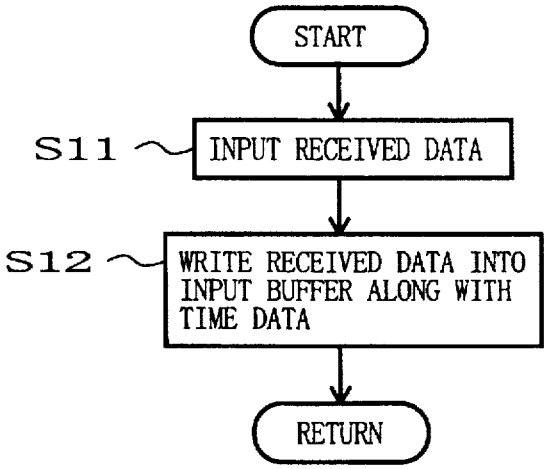
FIG. 4 is a flowchart of an interrupt process executed by the CPU.
Figure 5:
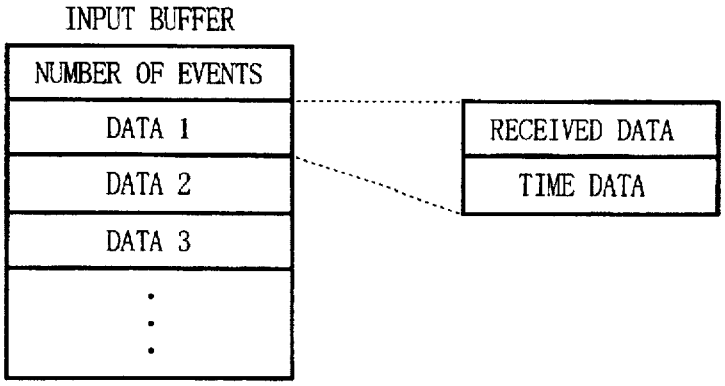
FIG. 5 is a diagram illustrating an example storage format of an input buffer.

The received data process of step S3 is triggered in response to an affirmative determination of step S2 made by detecting that received data from the MIDI interface 2 is written in the input buffer. The received data writing into the input buffer is effected by performing a top-priority interrupt process of FIG. 4 every time data are received via the MIDI interface 2. In the top-priority interrupt process of FIG. 4, the data received via the MIDI interface 2 are input to the musical instrument at step S11, and the input received data are written into the input buffer within the RAM 4 along with data indicative of a current time (time data). Although received data are immediately written into the input buffer whenever they are received, the thus-written received data are not immediately processed in the main routine, and hence the time data is written into the input buffer to identify a time when the received data were received. FIG. 5 shows examples of storing regions in the input buffer, where the number of received data is written in a storing region labelled "number of events" and the received data and corresponding time data are written in storing regions labelled "data 1", "data 2", "data 3" . . .

Figure 7:
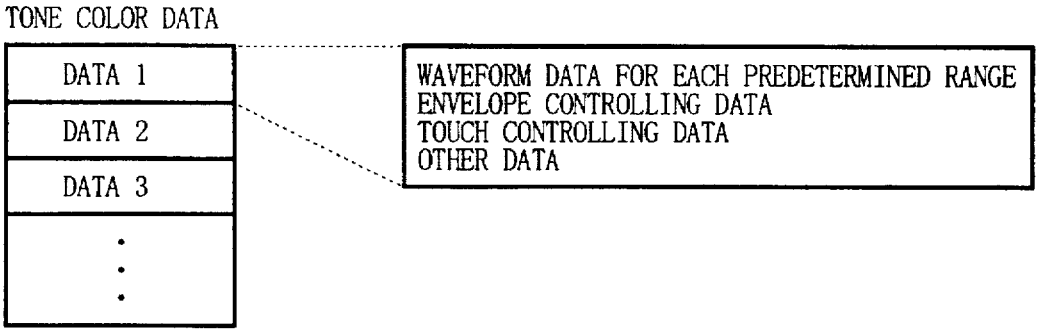
FIG. 7 is a diagram showing exemplary contents of tone color data stored in a tone color storing region of a RAM of FIG. 1.
Figures 6, 13A, 13B, 13C:
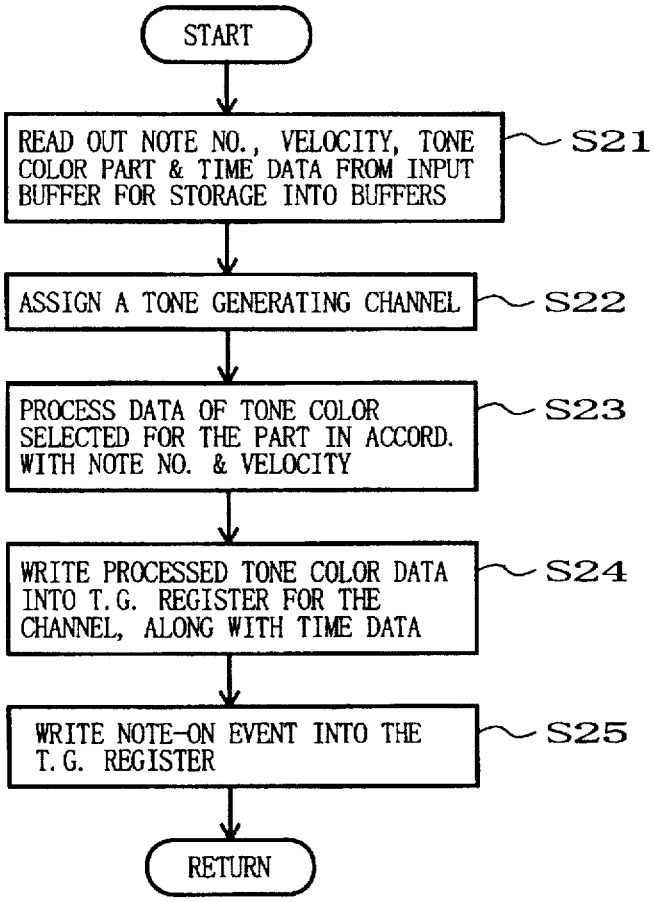
FIG. 6 is a flowchart of a note-on event process executed by the CPU.
FIGS. 13A to 13C are diagrams illustrating examples of storage formats of output buffers.

Now, the note-on event process of the received data process will be described below with reference to FIG. 6, where at first step S21, data indicative of a note number, velocity and tone color part and time data are read out from the input buffer and stored into respective registers. At next step S22, one of the tone generating channels is assigned for generating a tone signal corresponding to the note number corresponding to the note-on event. Then, at step S23, data of a tone color preselected for the tone color part by a tone color selecting operation in the switch event process (step S5 in FIG. 3) are read out from a tone color storing region of the RAM 4, and the read-out tone color data are processed in accordance with the note number and velocity. FIG. 7 shows exemplary contents of the tone color data stored in the tone color storing region of the RAM 4 after having been read out from the hard disk device 8. In the example of FIG. 7, each set of tone color data includes waveform data for plural cycles of each predetermined range, envelope controlling data, touch controlling data and other data.

Figure 8:
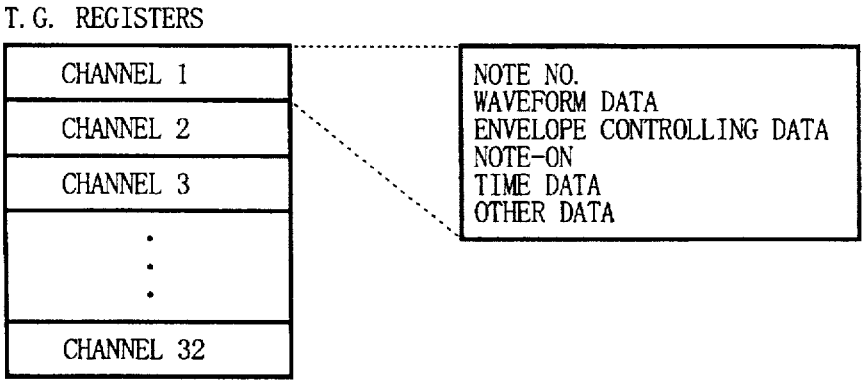
FIG. 8 is a diagram showing a manner in which tone color data are stored in a tone generator register.

At next step S24 of the note-on event process, the processed tone color data (including data indicative of a tone signal generating algorithm and pitch controlling data) are written, into a tone generator register for the assigned tone generating channel, along with the corresponding time data. Lastly, data indicative of a note-on event is written into the tone generator register at step S25, and the CPU 1 returns to the main routine. FIG. 8 shows a manner in which the tone color data are stored in the tone generator registers. In the example of FIG. 8, tone generator registers are provided for 32 tone generating channels, each of which has a region for storing the note number, envelope controlling data, note-on data, time data and other data and a working area. The other data includes data indicative of an algorithm relating to an effect selected through the switch event process.

Figure 9:
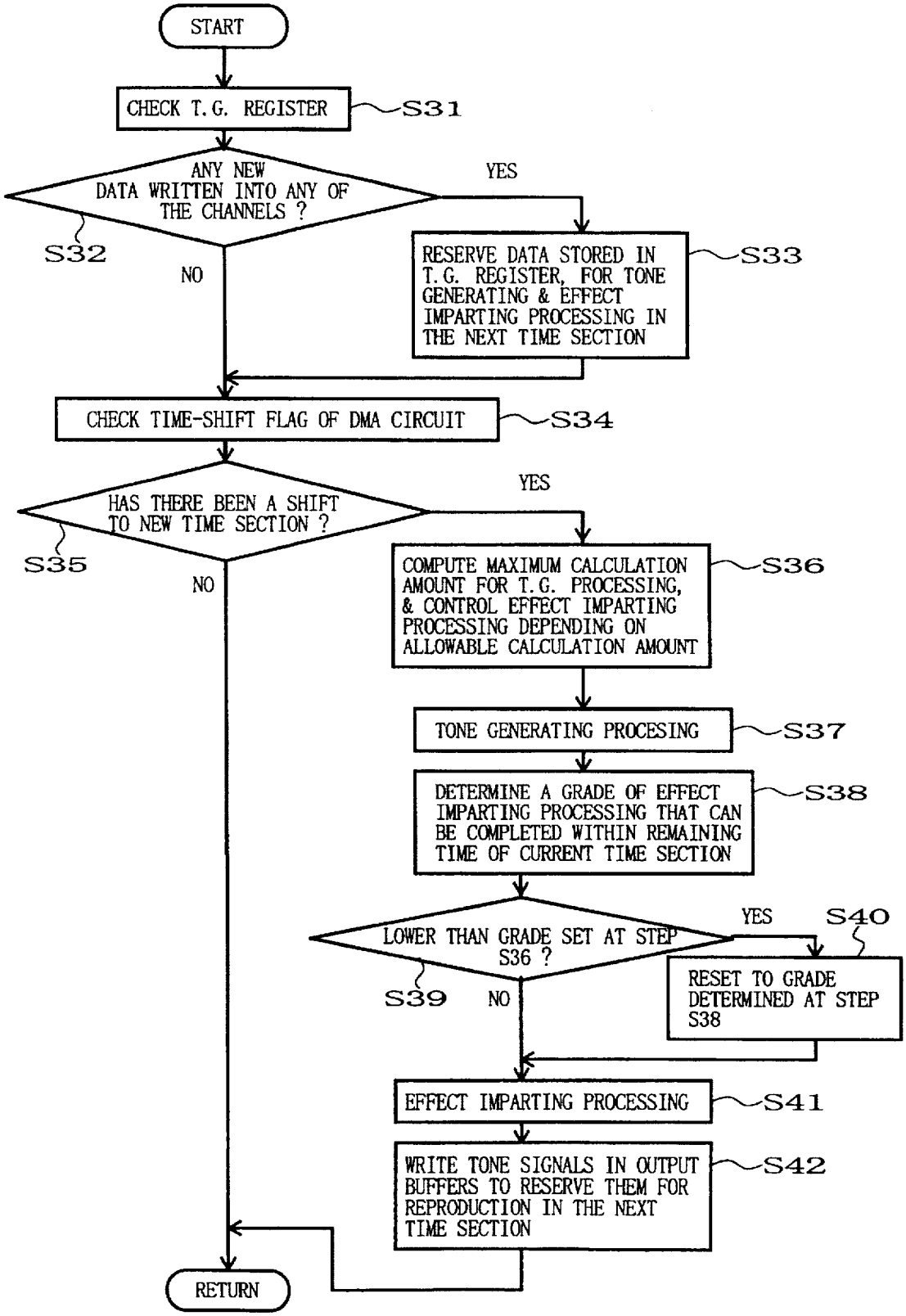
FIG. 9 is a flowchart illustrating an example of tone generator processing executed by the CPU.

FIG. 9 is a flowchart illustrating an example of the tone generator processing (step S6 in FIG. 3), where at first step S31, the CPU 1 checks the stored contents of the tone generator register for each tone generating channel (see FIG. 8). At next step S32, a determination is made as to whether any new data has been written into any of the tone generator registers. If new data has been written into any of the tone generator registers via the note-on event process of FIG. 6 or the like, an affirmative determination results at step S32, so that the CPU 1 goes to step S33, where the data stored in the tone generator register is reserved for the tone generating and effect imparting processing in the next time section. After this, the CPU 1 proceeds to step S34. If, on the other hand, no new data has been written into any of the tone generator registers, the CPU 1 proceeds to step S34 directly from step S32.

At step S34, the CPU 1 checks the time-shift flag which is set each time the DMA 9 circuit initiates the reproduction process on 128 samples of tone signals (i.e., each time there has been a shift from one time section to another), so as to determine whether the flag is currently set (i.e., whether there has been a shift from one time section to a new time section).

If the time-shift flag is not currently set as determined at step S35, the CPU 1 returns to the main routine to repeat the operations of step S7 and steps S2 to S5 (FIG. 3) and the operations of steps S31 to S35 of the tone generator processing until the flag is set. Once the time-shift flag is set, the CPU 1 goes from step S35 to step S36, where it computes a maximum amount of calculation actually necessary for processing of the software tone generator (i.e., a sum of an amount of calculation necessary for the tone generating processing and an amount of calculation necessary for the effect imparting processing) in the new time section. Typically, the maximum amount of calculation may be computed as an amount proportional to the number of the tone generating channels reserved at step S33. Then, depending on the computed amount of calculation and a calculation amount allowable for the software tone generator processing, the CPU 1 performs control over either or both of tone generation in some of the tone generating channels (i.e., deadening or muffling tones that are being generated in some of the tone generating channels) and contents of the effect imparting processing.

It is more preferable to control the contents of the effect imparting processing, because as compared with the tone generating processing, the effect imparting processing advantageously has less effect on a listener's auditory sense even when the contents are set to a relatively low grade. Thus, the following description will be made on the assumption that only the contents of the effect imparting processing are controlled by the CPU 1. Nevertheless, the control over the tone generating channels has an advantage that it can immediately complete necessary tone deadening operations, while the control over the contents of the effect imparting processing takes a considerable time to cause the processing amount to be increased or decreased to a desired level. For this reason, when it is necessary to effect the control urgently, it is preferable that the control over the tone generating channels be performed with priority over the control of the contents of the effect imparting processing.

In the following description, it is also assumed that the calculation amount allowable for the software tone generator processing in a single time section depends on the computing capability of the CPU 1 and an amount of calculation necessary for processing by other application software that is executed by the same CPU 1 in parallel with the processing of the software tone generator. Accordingly, the allowable calculation amount depends on the application software. Also, because the allowable calculation amount may vary over time even if the application software is the same, it is desirable to set the allowable calculation amount to be slightly lower than its upper limit.

As another example, the allowable calculation amount may be set optionally by a player or user within the limit of the computing capability of the CPU 1. Further, variation characteristics of the allowable calculation amount may be set optionally by the user in such a manner that the calculation amount varies over time in accordance with progression of a performance.

Figure 10:
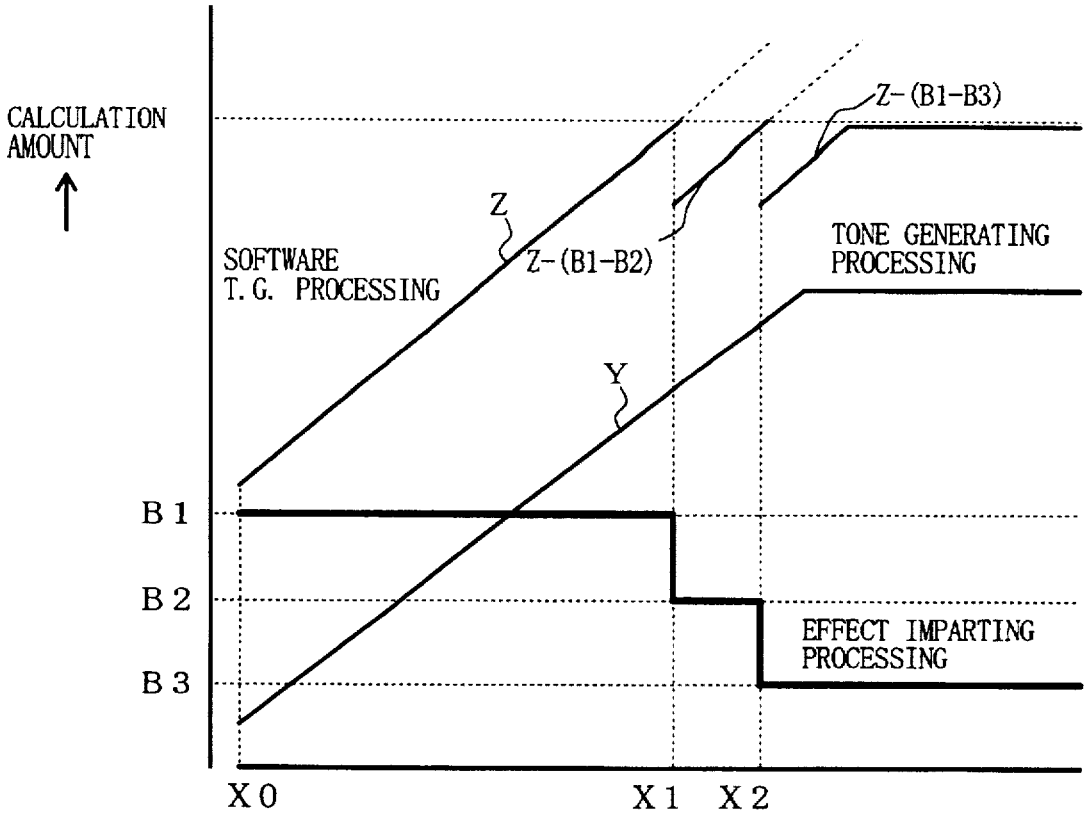
FIG. 10 is a diagram showing a relationship among various amounts of calculation necessary for various processing executed by the CPU.

FIG. 10 is a diagram showing a relationship among the allowable calculation amount, the amount of calculation necessary for the processing of the software tone generator, the amount of calculation necessary for the tone generating processing and the amount of calculation necessary for the effect imparting processing, in order to conceptually explain the above-mentioned control over the contents of the effect imparting processing. As shown, in the range from X0 to X1 where a maximum amount of calculation necessary for the processing of the software tone generator Z (i.e., a sum of the amount of calculation necessary for the tone generating processing Y and the amount of calculation necessary for the effect imparting processing when the contents of the process are set to a highest grade B1) does not exceed the allowable calculation amount A, the effect imparting processing is set to the highest grade.

In the range from X1 to X2 where the amount of calculation necessary for the tone generating processing Y is so great that the maximum amount of calculation Z exceeds the allowable calculation amount A but a difference between the amounts Z and A is less than the amount B1 and an amount of calculation necessary for the effect imparting processing when the contents of the process are set to a second highest grade B2), the effect imparting processing is set to the second highest grade. As a result, the amount of calculation necessary for the processing of the software tone generator becomes $$Z-(B1-B2)\leqq Z-A)=A$$

which falls within the limit of the allowable calculation amount A. In this manner, the amount of calculation necessary for the processing of the software tone generator is allowed to fall within the limit of the allowable calculation amount A in any ranges.

Now, details of the control over the contents of the effect imparting processing will be explained in relation to a reverberation effect which is a delay-based tonal effect.

Figure 11:
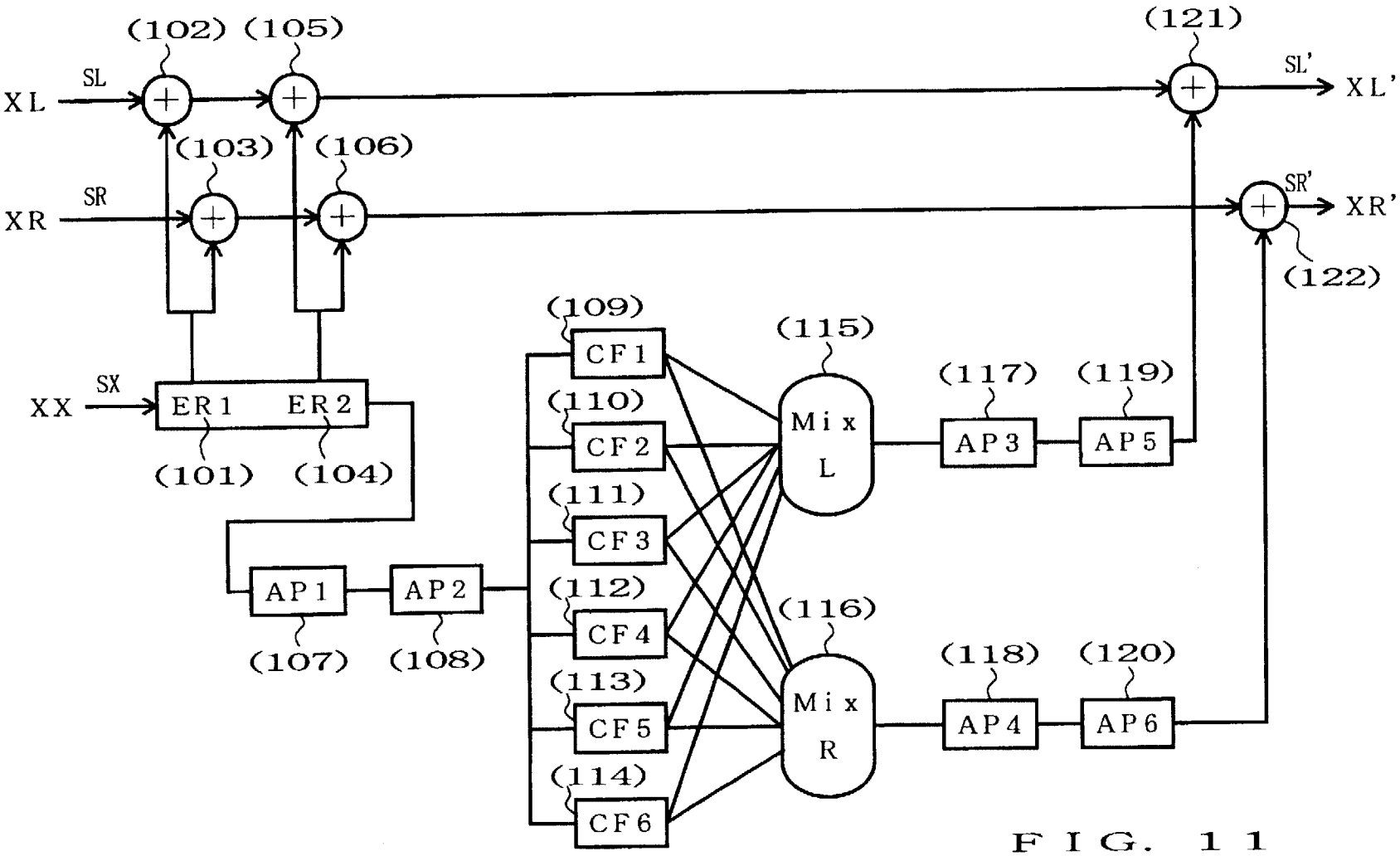
FIG. 11 is a diagram illustrating a reverberation imparting algorithm.

FIG. 11 illustrates an overall algorithm to achieve a reverberation effect. Tone signals generated via the tone generating processing are stored in buffers XL XR and XX (the buffer XL is for storing tone signals to be sent to the left channel of the stereophonic sound system without being subjected to the effect imparting processing, the buffer XR for storing tone signals to be sent to the right channel of the stereophonic sound system without being subjected to the effect imparting processing, and the buffer XX for storing tone signals to be sent to the effect imparting processing). Each tone signal SX read out from the buffer XX is first subjected to a process for early reflection ER1, as denoted at block (101) in FIG. 11, to obtain an initial reflected tone delayed by a predetermined time, and the initial reflected tone is added to tone signals SL and SR read out from the left- and right-channel buffers, respectively, as denoted at blocks (102) and (103). After this, the tone signal SX is further subjected to a process for early reflection ER2, as denoted at block (104), to again obtain an initial reflected tone, and the initial reflected tone is added to tone signals SL and SR read out from the left- and right-channel buffers, respectively, as denoted at blocks (105) and (106).

The thus-delayed tone signal SX is passed through all-pass filters AP1 and AP2 as denoted at blocks (107) and (108) and then passed in parallel through six comb filters CF1 to CF6, as denoted at blocks (109) to (114), providing different delay times. The reason why the tone signal SX is passed through a plurality of the comb filters CF1 to CF6 providing different delay times is to smooth the frequency characteristics of the signal as a whole, because wave-like frequency characteristics will result if the signal SX is passed through only one comb filter. The greater the number of the comb filters, the smoother become the frequency characteristics.

Then, the tone signals passed through the comb filters CF1 to CF6 are sent to two mixers MixL and MixR to be mixed together in each of the mixers MixL and MixR as denoted at blocks (115) and (116), so as to generate reverberated tone data having relatively coarse delay time intervals.

After this, each reverberated tone data generated by the mixer MixL is passed through all-pass filters AP3 and AP5, as denoted at blocks (117) and (119), providing delay times shorter than those provided by the comb filters CF1 to CF6, so as to form reverberated tone data having relatively fine delay time intervals. Each of the reverberated tone data from the all-pass filters AP3 and AP5 is added to the tone signal SL as denoted at block (121). On the other hand, each reverberated tone data generated by the mixer MixR is passed through all-pass filters AP4 and AP6, as denoted at blocks (118) and (120), providing delay times shorter than those provided by the comb filters CF1 to CF6, so as to form reverberated tone data having relatively fine delay time intervals. Each of the reverberated tone data from the all-pass filters AP4 and AP6 is added to the tone signal SR as denoted at block (122).

Tone signals SL' and SR' derived by adding the tone signals SL and SR with the respective initial reflected tones and reverberated tones are then written into left- and right-channel output buffers XL' and XR', respectively.

When the maximum amount of calculation necessary for the processing of the software tone generator processing (i.e., a sum of an amount of calculation necessary for the tone generating processing and an amount of calculation necessary for executing the whole of the above-mentioned algorithm) does not exceed the allowable calculation amount for the processing of the software tone generator processing, settings are made at step S36 to execute the whole algorithm (namely, the reverberation effect is set to a highest grade). When, on the other hand, the maximum amount of calculation is greater than the allowable calculation amount, the reverberation effect is set to a lower grade step by step by progressively removing some of the blocks of the algorithm in the following order.

More specifically, as the first step, block (114) of the comb filter CF6 is removed. If the maximum amount of calculation necessary for the software tone generator processing is still greater than the allowable calculation amount even after the removal of block (114), block (113) of the comb filter CF5 is further removed as the second step. If the maximum amount of calculation is still greater than the allowable calculation amount even after the removal of block (113), then blocks (117) and (118) of the all-pass filters AP3 and AP4 are removed as the third step. In a similar manner, block (108) of the all-pass filter AP2 is further removed as the fourth step, and block (104) of the early reflection ER2 is further removed as the fifth step.

In the embodiment, the order of the block removal is determined on the basis of two viewpoints: the one viewpoint being that the removal should be effected block by block in ascending order of effect on the listener's auditory sense, i.e., in such a manner that one of the blocks which will have the least effect on the listener's auditory sense when removed is removed prior to the other blocks (even when the number of the comb filters is decreased from "6" to "5" or "4", there will be no significant problem with the frequency characteristics smoothing and hence no significant effect on the listener's auditory sense); and the other viewpoint being that the removal should be effected block by block in descending order of effects attained by reduction of the calculation amount, i.e., in such a manner that one of the blocks which will contribute most to reduction of the calculation amount when removed is removed prior to the other blocks (reducing the blocks of the all-pass filters AP3 and AP4 prior to the block of the all-pass filter AP2 will contribute more to reduction of the calculation amount since the two blocks are removed at the same time).

When the amount of calculation necessary for the software tone generator processing has become no longer greater than the allowable calculation amount although the reverberation now has an improved grade as a result of the amount of calculation for the tone generating processing having been reduced by the block removal, the reverberation is set, at step S36, to a higher grade step by step by reviving the removed blocks from the fifth step to the first step, i.e., oppositely to the above-mentioned order.

As described above, the "control over the contents of the effect imparting processing" comprises controlling the amount of calculation for the effect imparting processing by progressively removing some of the blocks in the associated algorithm or progressively reviving the removed blocks. A greater amount of calculation for the effect imparting processing results in a higher grade of the processing, while a smaller amount of calculation for the effect imparting processing results in a lower grade of the processing. Although the foregoing description has been made in relation to the case where a reverberation effect is imparted by the effect imparting processing, the principle of the present invention may of course be applied to a case where another effect, such as chorus, flanger or feather, is imparted by the effect imparting process; that is, the amount of calculation for the other effect can be controlled to increase or decrease by removing some blocks in an algorithm for the effect or progressively reviving the removed blocks similarly to the above-mentioned.

If some of the blocks in the algorithm for the effect imparting processing are removed at step S36 (i.e., if the effect imparting processing is set to a lower grade than before), a later step to actually execute the effect imparting processing (step S41), rather than suddenly stopping the operation in each removed block, progressively weakens the operation in the block by changing parameters for the effect, so that the operation is stopped only after it is weakened to a degree that its stoppage does not result in any significant effect on the listener's auditory sense. Even during the time when the operation in a specific one of the blocks is progressively weakened, operational characteristics of the other block(s) than the specific one are varied to cancel out the effect on the listener's auditory sense (such as unnatural variation in tone volume level that can be sensed by the listener's ears) caused by variation in the operational characteristics in the specific block.

Similarly, if the removed blocks are revived at step S36 (i.e., if the effect imparting processing is set to a higher grade than before), the step to actually execute the effect imparting processing (step S41) initializes each of the so-far-detected blocks and then progressively strengthens the operation of the initialized blocks by changing parameters for the effect.

Once the operation of step S36 is completed in the above-mentioned manner, the CPU S37 moves to step S37, where tone signals for a single time section (128 samples of tone signals) are generated by performing the tone generating process on the data having been reserved as an object for calculation at step S33.

Figure 12:
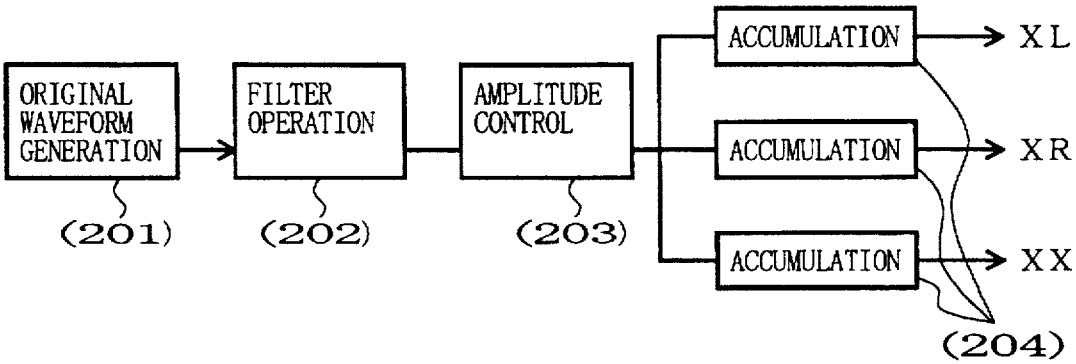
FIG. 12 is a block diagram outlining an algorithm for tone generating processing.

FIG. 12 is a block diagram outlining an algorithm for the tone generating processing. In this tone generating processing, for each of the tone generating channels, a process for reading out the reserved data from the corresponding tone generator register so as to generate an original waveform therefrom (block (210)), a process for performing a filter operation on the basis of information indicative of a filter coefficient so as to control tone color (block (202)) and a process for multiplying the waveform having undergone the filter operation by an amplitude (tone volume) value so as to control amplitude (block (203)) are executed, on a time-divisional basis, for a total of three output channels: the first one for tone signals to be sent to the left channel of the stereophonic sound system without being subjected to the effect imparting processing; the second one for tone signals to be sent to the right channel of the stereophonic sound system without being subjected to the effect imparting processing; and the third one for tone signals to be subjected to the effect imparting processing (see FIG. 11).

The above-mentioned process for generating the original waveform may be conducted using a known waveform generation method such as the waveform memory method, frequency modulation method or harmonic synthesis method. In the above-mentioned filter operation, the filter coefficient is varied over time or in accordance with touch or other performance information in order to control tone color. Further, in the above-mentioned amplitude control, a tone volume envelope for controlling time-varying tone volume from the start to end of tone generation in each of the tone generating channels is weighted with a ratio corresponding to the output channel in question in order to obtain three different pieces of tone volume information for the output channels, and the three pieces of tone volume information are sequentially multiplied to an input waveform on a time-divisional basis. By adjusting any of the weighting ratios, it is possible to, for example, provide a stereophonic or tone image localizing effect and increase the volume of the effect-imparted tone.

Thereafter, the tone signals generated in the tone generating channels through the above-mentioned processes are accumulated for each of the output channels and stored into the respective buffers XL, XR and XX (block 204). FIGS. 13A to 13C shown by way of example how the tone signals are stored in the buffers XL, XR and XX, each of which includes a region storing 128 samples of the tone signals generated within a single time section.

Returning now to FIG. 9, step S38, immediately after step S37, determines a grade of the effect imparting processing which can be completed within a remaining time of the current time section, depending on the remaining time. At next step S39, a determination is made as to whether or not the grade determined at step S38 is lower than that previously set at step S36. If answered in the affirmative at step S39, the CPU 1 goes to step S40 in order to replace the grade of the effect imparting processing with the grade newly determined at step S38, and then proceeds to step S41. if, on the other hand, the newly determined grade is not lower than the grade previously set at step S36, the CPU 1 proceeds to step S41 with the previously set grade left unchanged.

The reason why the effect imparting processing grade is reconsidered here is that if the grade set at step S36 is continued to be used, the effect imparting processing may sometimes not be completed within the remaining time of the section due to some new conditions arising after step S36 (e.g., in a situation where a time more than expected was taken for interrupt processes of the application software being executed by the CPU 1 in parallel with the software tone generator processing).

At step S41, the tone signals are read out from the buffers XL, XR and XX (FIGS. 13A to 13C) and the effect imparting processing to impart an effect selected by the switch event process (step S5 of FIG. 3) is performed on the read-out tone signals on the basis of the amount of calculation corresponding to the grade set at step S36 or S40. Then, the tone signals having undergone the effect imparting processing are written into the left- and right-channel output buffers XL' and XR', respectively. Details of the effect imparting processing are as described above in relation to step S36 with reference to FIG. 11. By executing the effect imparting processing in the thus-controlled manner, the software tone generator processing and application software executed in parallel with the tone generator processing as well can be appropriately completed within each of the time sections without causing any adverse effects.

Lastly, at step S42, the tone signals written in the respective output buffers XL' and XR' (such as tone signals SL' and SR' shown in FIG. 11) are reserved as signals to be reproduced by the DMA circuit 9 in the next time section (immediately following the current time section), after which the CPU 1 returns to the main routine. In the next time section, the above-described reproduction process will be performed on the reserved tone signals by means of the DMA circuit 9.

As described above, in some of the time sections when the other application software and tone generating processing involve great amounts of calculation, the embodiment of the present invention sets the effect imparting processing to a lower grade so as to reduce the calculation amount therefor as compared with other cases where the two processing involve smaller amounts of calculation, so that more of the computing capability of the CPU 1 can be allocated to the other processing. On the other hand, in another time section when the other processing involves a relatively small amount of calculation, the embodiment sets the effect imparting processing to a higher grade so as to increase the calculation amount therefor and thereby impart a better or higher-quality effect to the tone signals. Such an arrangement permits a more efficient distribution of the CPU resources. Particularly, when the number of simultaneously generated tones is small, the effect imparting processing of higher grade allows effect-imparted tones to be heard more clearly, thus providing an even better effect on the listener's auditory sense.

Figure 14:
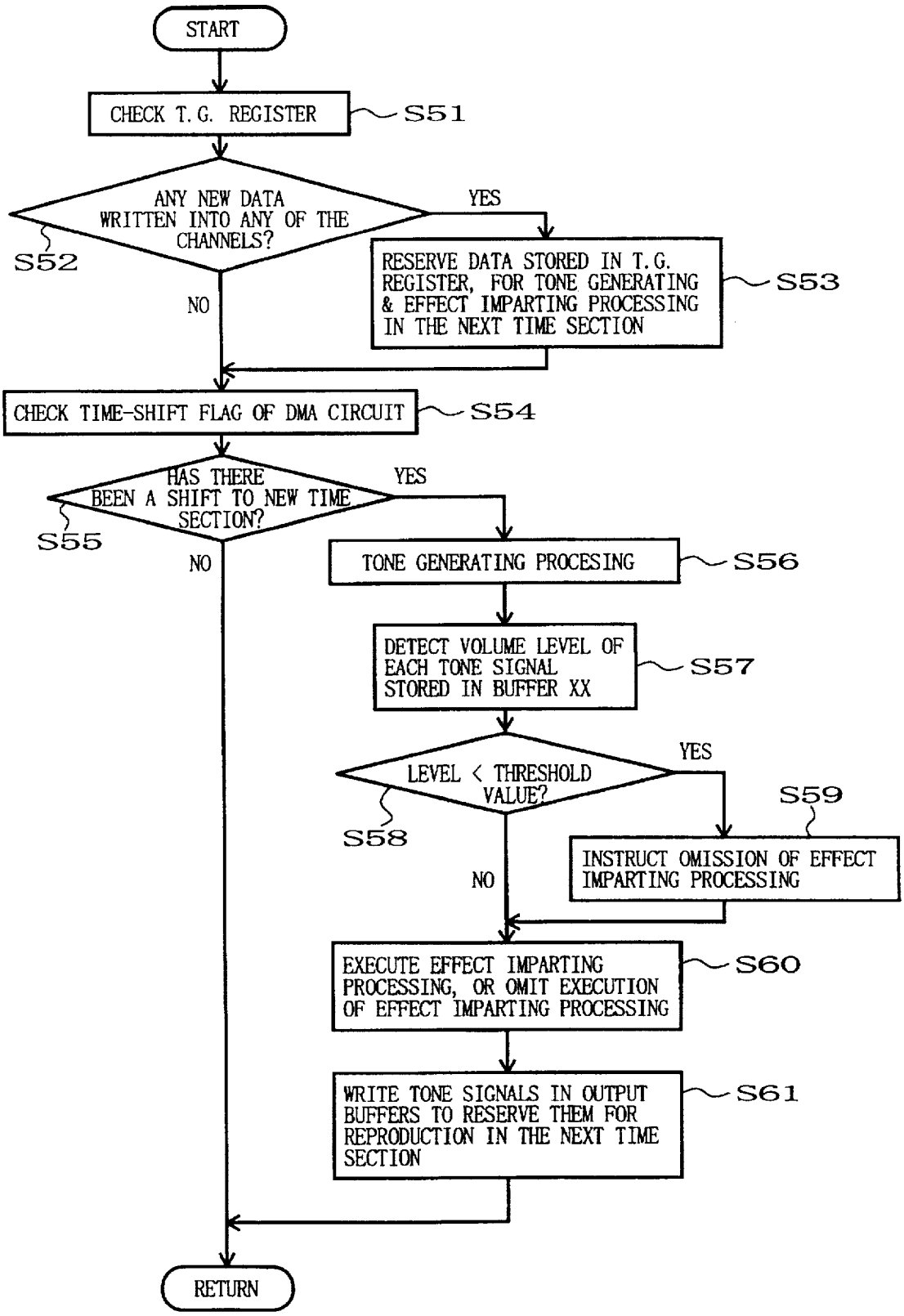
FIG. 14 is a flowchart illustrating another example of the tone generator processing executed by the CPU.

FIG. 14 is a flowchart illustrating another example of the tone generator processing executed by the CPU 1. This tone generator processing is somewhat similar to that of FIG. 9 exept that operations of steps S51 to S56 are not present in the FIG. 9 processing. Operations of steps in FIG. 14 correspond to steps S in FIG. 9, respectively. At step S57 following step S56, a detection is made of a tone volume level of each of the tone signals stored in the buffer XX at step S56 (i.e., tone signals to be subjected to the effect imparting processing). At next step S58, it is determined whether the detected tone volume level is lower than a predetermined threshold value which, for example, is set to correspond to a level when no tone is being sounded (i.e., zero or very small value that can not be sensed by listner's ears).

If the detected tone volume level is equal to or higher than the predetermined threshold value, the CPU 1 goes to step S60 in order to execute the effect imparting processing for an effect selected by the effect selecting switch. At last step S61, the tone signals having the effect imparted thereto at step S60 are written into the left- and right-channel output buffers XL' and XR' and reserved in the DMA circuit 9 for reproduction in the next time section. Then, the CPU 1 returns to the main routine.

If, on the other hand, the detected tone volume level is lower than the predetermined threshold value as determined at step S58, the CPU 1 at step S59 instructs omission of the execution of the effect imparting processing and then goes to step S60, where the execution of the effect imparting processing is omitted in accordance with the instruction. Then, at step S61, the tone signals stored in the buffers XL and XR and having no effect imparted thereto (such as tone signals SL and SR in FIG. 11) are written into the output buffers XL' and XR' and thus reserved in the DMA circuit 9 for subsequent reproduction.

In the above-mentioned manner, for the time sections when the tone volume of each tone signals to be sent to the effect imparting processing is below the threshold value as when no tone is being sounded, the execution of the effect imparting processing is omitted, so that the entire computing capability of the CPU 1 can be allocated to the tone generating processing and other application software processing without wasting the computing capability in the effect imparting processing. This permits an efficient distribution of the CPU resources.

In the above-described embodiment, either tone generation in some of the tone generating channels or effect imparting processing is controlled at step S36, depending on both of the maximum necessary calculation amount and allowable calculation amount for the software tone generator processing. Alternatively, at step S36, the tone generating processing in some of the tone generating channels may be controlled depending on both the maximum necessary calculation amount and the allowable calculation amount; that is, when the maximum necessary calculation amount is greater than the allowable calculation amount, the tone generating processing may be set to a lower grade step by step by removing some of the blocks of the tone generating processing algorithm with respect to some of the channels, in such a manner as illustrated in FIGS. 10 and 11 in connection with the control over the contents of the effect imparting processing.

Further, the present invention has been described above as being applied to the case where the tone generating processing and effect imparting processing on tone signals generated through the tone generating processing are executed along with other application software by shared use of the same CPU. Alternatively, the present invention may be applied to a case where the CPU executes, in parallel with other application software, the effect imparting processing on tone signals supplied from another source than via the CPU (e.g., tone signals reproduced by an audio device such as a compact disk player, tone signals input through a microphone and converted into digital form, tone signals synthesized via tone synthesizing software, or tone signals generated via execution of the tone generating processing by another CPU). In such a case, the CPU of the personal computer controls the effect imparting processing, at step S36, on the basis of a comparison between the allowable calculation amount and the amount of calculation necessary for the effect imparting processing, since the CPU itself does not execute the tone generating processing. In another alternative, the present invention may be applied to a case where the CPU does not execute other application software and executes only the tone generating processing and effect imparting processing; in this case, the allowable calculation amount is determined only on the basis of the CPU's computing capability at step S36 of the tone generator processing.

Moreover, the present invention has been described above as being applied to the software tone generator where the CPU of the personal computer controls the tone generating processing and effect imparting processing on the basis of data received via the MIDI interface. Alternatively, the present invention may of course be applied to another-type software tone generator where the CPU provided within the electronic musical instrument executes the tone generating processing and effect imparting processing. In such a case, the CPU has to execute the software generator processing in parallel with processing by a tone color editor or sequencer, so that the allowable calculation amount is determined at step S36 of the tone generator processing depending on the CPU's computing capability and amount of calculation necessary for the processing in the tone color editor or sequencer.

Furthermore, while the present invention has been described above as being applied to the software tone generator, it may of sophisticated gene to a more sophisticated general-purpose DSP which is capable of executing the effect imparting processing in parallel with other processing.

As has been described so far, the present invention is advantageously applied to cases where the effect imparting processing to impart a desired effect to a tone signal and other processing are executed by shared use of the same microprocessor. When the other application processing involves a relatively great amount of calculation, the present invention operates to allocate more of the computing capability of the microprocessor to the other processing; conversely, when the other application processing involves a relatively small amount of calculation, the present invention operates to execute the effect imparting processing with a higher-grade content. The present invention thus arranged, by permitting an efficient distribution of the microprocessor resources, achieves a superior benefit that it can give an tone an effect of highest possible quality that is obtainable through a limited amount of arithmetic operations.

Also, according to the present invention, the player or user is allowed to adjust the grade of the effect imparting processing at any desired time while actually listening to performed tones.

Further, in applications where the same microprocessor executes the effect imparting processing and other processing as in a software tone generator and general-purpose DSP, when a volume level of a tone signal is below a predetermined value such as when no tone is being sounded at all, the entire computing capability can be allocated to the other processing without wasting the computing capability in the effect imparting processing. Thus, the present invention achieves an efficient distribution of the microprocessor resources.

A description will now be given on another embodiment of the effect imparting device in accordance with the present invention, with reference to FIGS. 15 to 20.

Figure 15:
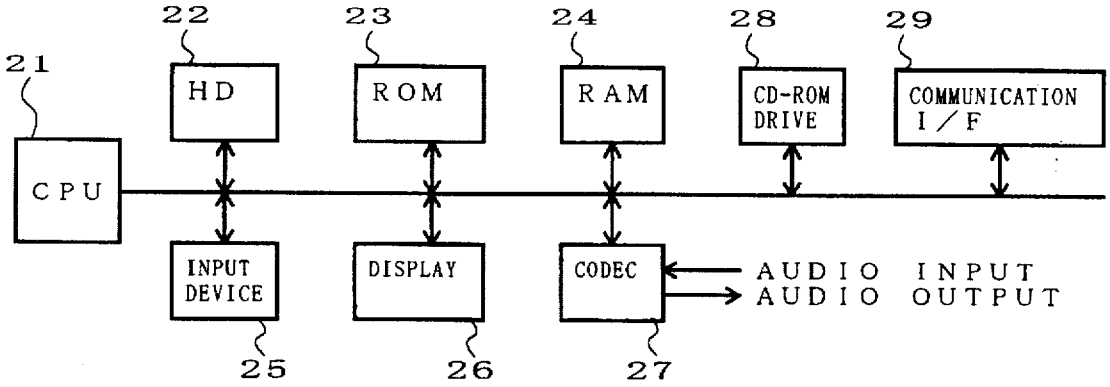
FIG. 15 is a block diagram illustrating another embodiment of the present invention.

FIG. 15 is a block diagram of a personal computer which implements this embodiment of the effect imparting device. The personal computer is designed to execute effect imparting arithmetic operations and other application software under the so-called "multitask control". The multitask control is a well-known control technique and its description will not be made here. In the personal computer of FIG. 15, reference numeral 21 denotes a CPU which controls the overall operation of the personal computer. The CPU 21 also functions as a calculating means for executing the effect imparting arithmetic operations and other application software. A hard disk device 22 stores various application software, data files and various other files. A ROM 23 has control programs prestored therein, and a RAM 24 is used primarily as a working memory means or buffers. The personal computer further includes an input device 25 such as a keyboard or mouse, a display 26 such as a CRT display, and a CODEC (coder and decoder) 27 for performing coding/decoding of audio signals exchanged between the personal computer and an external device such as a speaker. A CD-ROM drive 28 and communication interface 29 perform generally the same functions as the counterparts described in relation to FIG. 1.

Figure 16A:
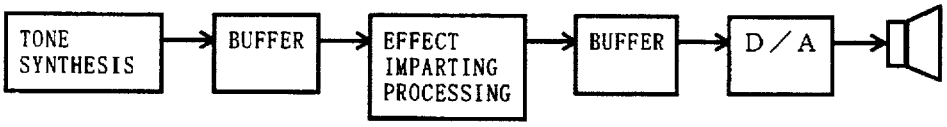
FIGS. 16A to 16C are block diagrams showing several examples of effect imparting processing executed in the embodiment of FIG. 15.
Figure 16B:
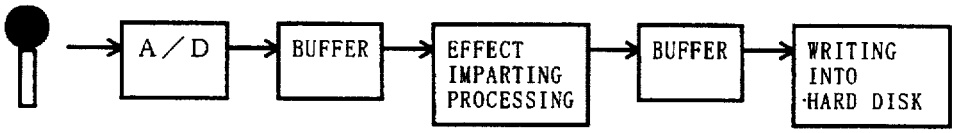
Figure 16C:
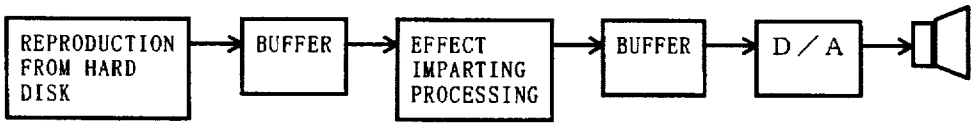

FIGS. 16A to 16C are block diagrams showing several exemplary manners in which effect imparting processing, the subject matter of the present invention, is executed by the personal computer.

In the example of FIG. 16A, the CPU 21 executes tone synthesizing processing and effect imparting processing on digital audio signals generated via the synthesizing processing using the RAM 24 as buffers. Final effect-imparted digital audio signals from the effect imparting processing are accumulated into the buffer RAM 24 and are then converted into analog representation by the CODEC 27 to be ultimately output to the speaker or the like.

In the example of FIG. 16B, analog audio signals picked up by a microphone or the like are converted via the CODEC 27 into digital representation and accumulated into the buffer RAM 24. The CPU 21 sequentially reads out the accumulated digital audio signals from the RAM 24 to perform the effect imparting processing on the signals. Then, final effect-imparted digital audio signals from the effect imparting processing are written into the hard disk device 22 by way of the buffer RAM 24.

Further, in the example of FIG. 16C, digital audio signals are reproduced from the hard disk device 22 and accumulated into the buffer RAM 24. The CPU 21 sequentially reads out the accumulated digital audio signals from the RAM 24 to perform the effect imparting processing on the signals. Then, final effect-imparted digital audio signals from the effect imparting processing are transferred to the CODEC 27 by way of the buffer RAM 24, and the CODEC 27 converts the digital audio signals into analog representation, which are ultimately output to the speaker or the like.

The CPU 21, which executes the effect imparting processing in one of the above-described manners, is capable of executing other application software in parallel with the effect imparting processing under the multitask control. However, the effect imparting processing involving a heavy load on the CPU 21 will often lead to a significant obstacle to the CPU 21 in executing the other application software. To avoid such a problem, this embodiment performs control to lessen the load of the CPU 21 by minimizing wasteful operations in the execution of the effect imparting processing.

The load lessening control in this embodiment will be described in detail below with reference to FIGS. 17A to 17D. As mentioned earlier, digital audio signals to be sent to the effect imparting processing are sequentially accumulated into the RAM 24, and the CPU 21 constantly monitors the accumulated digital audio signals. For each period when one or more digital audio signals above a predetermined amplitude level are supplied, the effect imparting processing is executed on the digital audio signals having been accumulated in the RAM 24 within a latest one of predetermined time sections preceding the current time point, so as to output the resultant effect-imparted signals (see FIG. 17A).

Figure 17A:
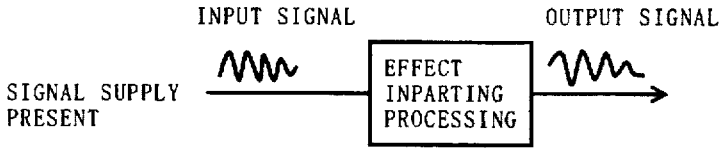
FIGS. 17A to 17D are block diagrams showing examples of control over the effect imparting processing executed in the embodiment of FIG. 15.
Figure 17B:
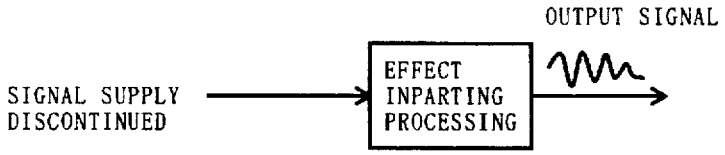
Figure 17C:
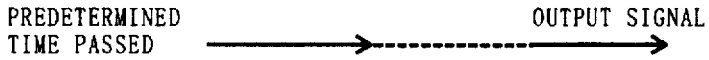
Figure 17D:
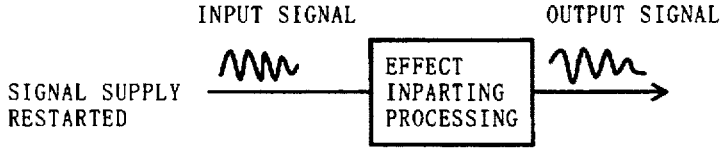

Once the supply of digital audio signals has been discontinued, 0's are accumulated into the RAM 24 in succession; however, the CPU 21 continues to execute the effect imparting processing on the digital audio signals having been accumulated in the RAM 24 within the latest predetermined time section (see FIG. 17B). Then, upon lapse of a predetermined time since the discontinuation of the supply of digital audio signals, the CPU 21 stops the execution of the effect imparting processing (see FIG. 17C), because stored data having been accumulated within the latest predetermined time period are all of value "0" and it is now meaningless to continue the effect imparting processing. Then, once the supply of digital audio signals has been restarted, the CPU 21 resumes the effect imparting processing (FIG. 17D).

Because this embodiment does not execute the effect imparting processing at any time sections when its execution is meaningless, the load of the CPU 21 is lessened accordingly, and the part of the computing capability of the CPU 21 saved in this way can be allocated to the other application software.

Figure 19:
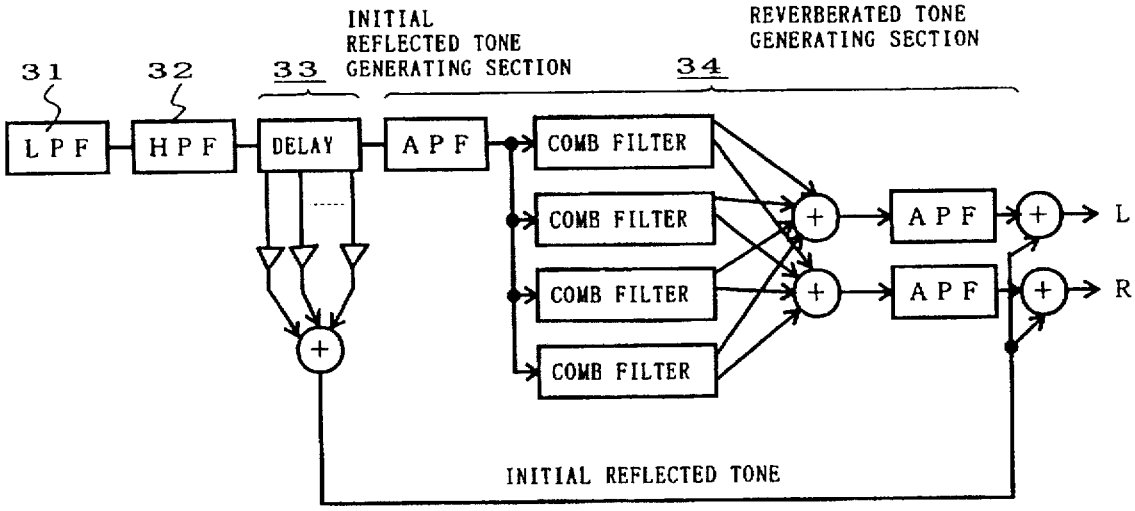
FIG. 19 is a block diagram illustrating details of the reverberation imparting process executed in the embodiment of FIG. 15.
Figure 18:
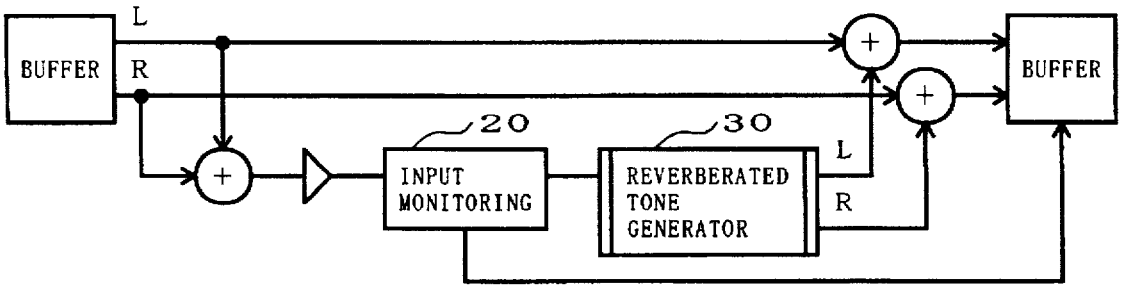
FIG. 18 is a block diagram showing a reverberation imparting process executed in the embodiment of FIG. 15 in terms of functional interrelations among various hardware components.

The embodiment of the present invention will be described further in relation to a case where the effect imparting processing is executed to impart a reverberation effect to a digital audio signal. FIG. 18 is a block diagram showing the effect imparting process executed in the embodiment in terms of functional interrelations among various hardware components. The principal components include a reverberated tone generator 30 for creating a digital audio signal of a reverberated tone, and an input monitoring section 20 for monitoring the level of each digital audio signal supply to the reverberated tone generator 30. FIG. 19 is a block diagram showing details of operations executed by the reverberated tone generator 30 in terms of functional interrelations among various hardware components, in which the generator 30 comprises a low-pass filter (LPF) 31, a high-pass filter 32, an initial reflected tone generating section 33 composed of a FIR (finite impulse response) filter, and a reverberated tone generating section 34 composed of all-pass filters (APFs) and comb filters.

In the embodiment thus arranged, the effect imparting processing for a reverberation effect is carried out in the following manner. First, left- and right-channel digital audio signals are sequentially accumulated into the buffer RAM 24. The accumulated left- and right-channel digital audio signals are read out from the buffer RAM 24 one by one in an alternate manner (i.e., in such a manner that one left- or right-channel digital audio signal is read out after readout of one right- or left-channel digital audio signal, and so on), and the read-out signals are supplied to the reverberated tone generator 30 via the input monitoring section 20.

In the reverberated tone generator 30, reverberated tone generating operations are performed alternately for the left- and right-channels under the time-divisional control, so as to generate digital audio signals of reverberated tones for the left- and right-channels. Namely, in the arrangement of FIG. 19, for example, the digital audio signals of the individual channels are passed through the low-pass filter 31 and high-pass filter 32 for removal of unnecessary spectral components outside the audio frequency band, and are then sequentially sent to a delay section of the initial reflected tone generating section 33. For each of the channels, the reverberated tone generating section 33 performs arithmetic operations to convolute a train of predetermined coefficients into the digital audio signals supplied to the delay section, so as to generate digital audio signals of an initial reflected tone for the channel. In the meantime, the digital audio signals used in the convoluting arithmetic operations are sent from the delay section of the initial reverberated tone generating section 33 to the reverberated tone generating section 34, which generates digital audio signals of a reverberated tone for each of the channels. After this, the digital audio signals of initial reflected and reverberated tones are added together, for each of the channels, so as to provide final digital audio signals of a reverberated tone.

The input monitoring section 20 constantly monitors the level of each digital audio signal to be reverberated. When digital audio signals each of which may be regarded as having a value "0" are supply for more than a predetermined time period, the input monitoring section 20 causes the reverberated tone generator 30 to stop the process (i.e., the CPU 21 discontinues a process corresponding to the reverberated tone generator 30). Then, once the supply of digital audio signals above the predetermined level has been restarted, the input monitoring section 20 causes the reverberated tone generator 30 to resume the process.

Figure 20:
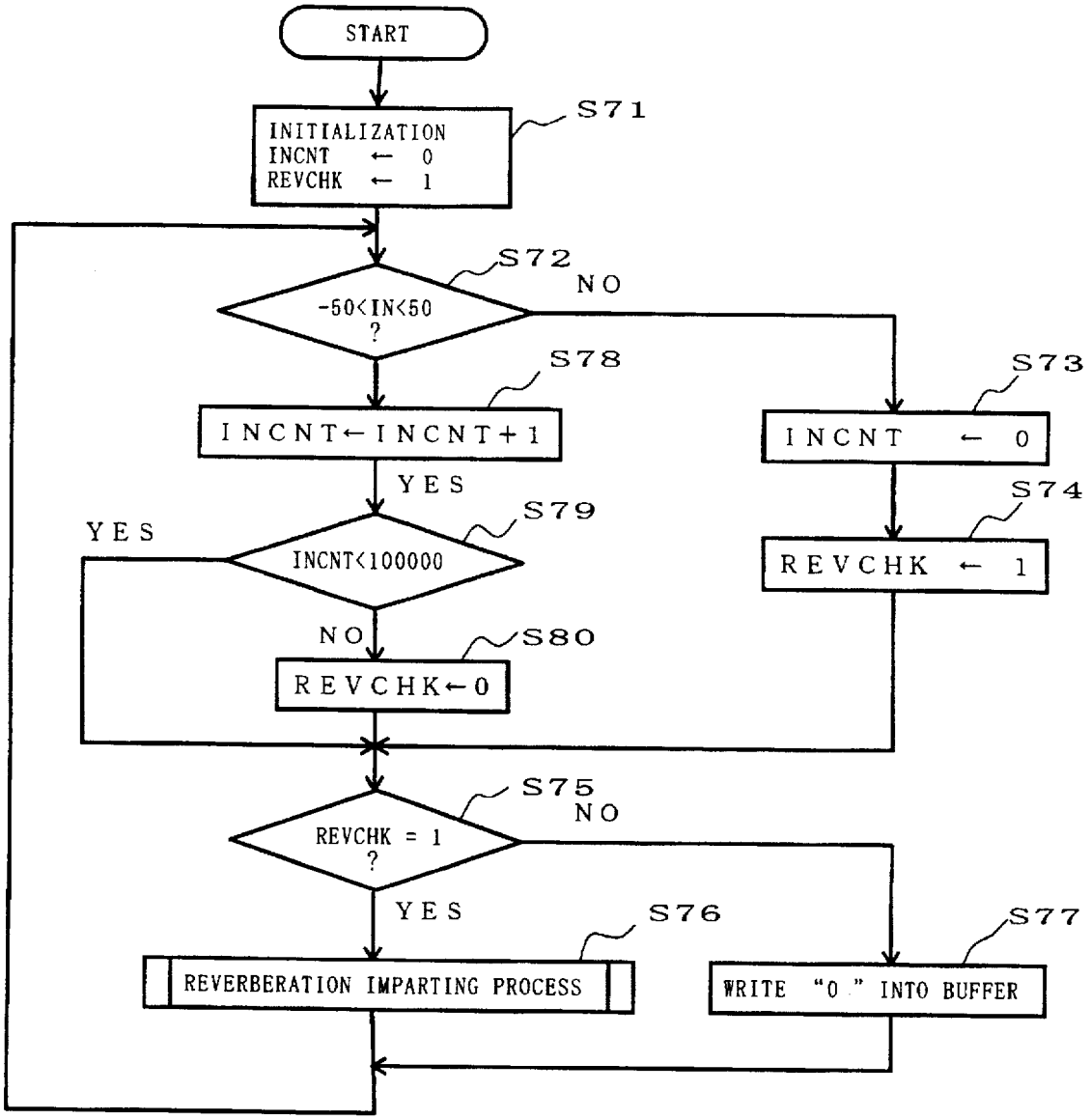
FIG. 20 is a flowchart illustrating exemplary behavior of the embodiment of FIG. 15.

FIG. 20 is a flowchart illustrating a subroutine relating to the input monitoring section 20. Upon start of the subroutine, predetermined initialization is effected at step S71, where initial values "0" and "1" are written into an input time register INCNT and reverberation impartment flag REVCHK, respectively. The program then goes to step S72 in order to determine whether the level IN of a digital audio signal to be currently sent to the reverberated tone generator 30 is low enough to be safely regarded as "0", i.e., whether the level IN satisfies a condition of $-50<IN<50$. If answered in the negative at step S72, "0" is written into the input time register INCNT at step S73 and "1" is written into the reverberation impartment flag REVCHK at step S74, after which the program proceeds to step S75. At step S75, a determination is made as to whether the reverberation impartment flag REVCHK is currently at "1". If the reverberation impartment flag REVCHK is currently at "1" (YES) as determined at step S75, the reverberation imparting process is executed by the reverberated tone generator 30 at step S76, and the program loops back to step S72. Thereafter, whenever the level IN of a digital audio signal to be sent to the reverberated tone generator 30 is greater than the predetermined level, the process by the reverberated tone generator 30 is conducted. The condition "$-50<IN<50$" used for the signal level determination may be changed to any optional value as long as it provides a suitable means for detecting that the signal is at a sufficiently low level (−50 to −60 dB).

Once the level IN of the digital audio signal has become low enough, an affirmative (YES) determination results at step S72, the program proceeds to step S78 to increment the stored content of the input register INCNT by one. Then, at next step S79, a determination is made as to whether the input register INCNT is currently at a value smaller than "100000". With an affirmative answer, the program moves to step S75 to further determine whether the reverberation impartment flag REVCHK is currently at "1". If the flag REVCHK is currently at "1" as determined at step S75, the reverberation imparting process is executed by the reverberated tone generator 30 at step S76, after which the program loops back to step S72. Thereafter, as long as the supplied digital audio signal maintains the extremely low level IN, the reverberation imparting process is performed on the signal at step S76, although the stored content of the input register INCNT is incremented as the time passes.

With the above-mentioned operations, the input register INCNT keeps recording each elapsed time since the sufficiently low level of the digital audio signal is first detected. As long as step S79 determines that the input time register INCNT is at a value smaller than "100000", it is possible that a reverberated tone corresponding to previously supplied digital audio signals still remains in the reverberated tone generator 30 although they are of low level, and hence the reverberation imparting process continues to be executed at step S76.

The standard value to be compared with the stored value of the input time register INCNT need not necessarily be "100000" and may be optionally set within a range where a reverberated tone that should be output can be generated in appropriate manner; besides, this standard value need not be a fixed value. Specifically, the standard value may be chosen such that the reverberation imparting process continues to be executed by the reverberated tone generator 30 at step S76 until about 5–10 seconds has passed since the level of the input digital audio signal fell below the predetermined low level. The standard value may be set optionally by the user, or may be automatically set depending on a given reverberating time in the reverberated tone generator 30.

As mentioned above, the reverberation imparting process continues to be executed at step S76 as long as the input time register INCNT is at a value smaller than "100000". But, once the input time register INCNT has reached a value not smaller than "100000", a negative (NO) determination results at step S79, and "0" is written into the reverberation impartment flag REVCHK at step S80, after which the program moves to step S75. This time, a negative determination results at step S75 and then the program branches to step S77 in order to write "0" into the buffer, after which the program loops back to step S72.

Thereafter, as long as the supplied digital audio signal maintains the extremely low level IN, the reverberation imparting process is not executed at step S36 and "0"s are sequentially written into the buffer, during which time the input time register INCNT keeps incrementing its stored value one by one.

Then, once the level IN of the digital audio signal has increased to cause a negative determination result at step S72, "0" is written into the input time register INCNT at step S73 and "1" is written into the reverberation impartment flag REVCHK at step S74. After this, the program goes via step S75 to step S76, in order to execute the reverberation imparting process by means of the reverberated tone generator 30. It is to be understood that only when the program takes step S76 for the first time after resumption of the subroutine, the stored contents in the delay section and individual filters are initialized.

As described above, the level of each digital audio signal to be reverberated is checked by the input monitoring section 20, and the reverberation imparting process is executed by the reverberated tone generator 30 only as long as the arithmetic operations provide meaningful results.

While the above embodiment of the present invention has been described in relation to the reverberation imparting process, the present invention may of course be applied to impartment of another effect such as chorus or distortion.

The invention described so far with reference to FIGS. 15 to 20 is characterized in that the execution of the effect imparting processing is discontinued when the supply of audio signal is stopped continuously for a predetermined time period and is resumed when the supply of audio signal is restarted. With such an arrangement, the present invention achieves the benefit that it can efficiently execute the effect imparting processing on audio signals without involving wasteful arithmetic operations of the microprocessor or other computing means.

What is claimed is:

1. A tone processing method for executing effect imparting processing to impart an effect to a supplied tone signal and for executing other processing by shared use of a same microprocessor, said method comprising:

a first step of controlling a grade of said effect imparting processing, depending on an amount of calculation necessary for said other processing; and a second step of executing said effect imparting processing on the supplied tone signal in accordance with the grade of said effect imparting processing controlled in said first step.

2. A tone processing method for executing effect imparting processing to impart an effect to a supplied tone signal and for executing other processing by shared use of a same microprocessor, said method comprising:

a first step of controlling a grade of said effect imparting processing, depending on an amount of calculation necessary for said other processing; and a second step of executing said effect imparting processing on the supplied tone signal in accordance with the grade controlled in said first step, wherein said first step of controlling the grade of said effect imparting processing includes removing one or more blocks forming an algorithm of said effect imparting processing and reviving the removed blocks, and wherein the algorithm of said effect imparting processing comprises a combination of one or more algorithm units and said blocks correspond to said algorithm units.

3. A tone processing method as defined in claim 2, wherein removal of the one or more blocks in said first step is executed block by block in a predetermined order.

4. A tone processing method as defined in claim 2 wherein removal of the blocks in said first step is executed block by block in such order that one of the blocks whose removal contributes most to reduction of an amount of necessary calculation is removed prior to the other block.

5. A tone processing method as defined in claim 2 wherein operation of each of the blocks removed in said first step is weakened progressively in said second step.

6. A tone processing method as defined in claim 5 wherein an effect on a listener's auditory sense caused by a change in operational characteristics of each said removed block is cancelled out by varying operational characteristics of the other block left unremoved.

7. A tone processing method for executing effect imparting processing to impart an effect to a supplied tone signal and for executing other processing by shared use of a same microprocessor, said method comprising:

a first step of controlling a grade of said effect imparting processing, depending on an amount of calculation necessary for said other processing; and a second step of executing said effect imparting processing on the supplied tone signal in accordance with the grade controlled in said first step, wherein for each time section having a predetermined length, said method executes tone generating processing to generate tone signals in a specific number of tone generating channels corresponding to a specific number of tones to be simultaneously generated and said effect imparting processing on the tone signals generated by said tone generating processing, and wherein said first and second steps are performed for each said time section.

8. A tone processing device comprising:

processor means for executing effect imparting processing to impart an effect to a supplied tone signal and other processing by shared use of a same to microprocessor; and control means for controlling a grade of said effect imparting processing, depending on an amount of calculation necessary for said other processing.

9. A tone processing method for executing effect imparting processing to impart an effect to a supplied tone signal and for executing other processing by shared use of a same microprocessor, said method comprising:

a first step of selectively designating a grade of said effect imparting processing, wherein the number of calculations associated with said effect imparting processing varies according to the grade such that the number of calculations increases as the grade becomes higher; and a second step of executing said effect imparting processing on the supplied tone signal in accordance with the grade corresponding to the grade designated in said first step.

10. A tone processing device comprising:

processor means for executing effect imparting processing to impart an effect to a supplied tone signal and other processing by shared use of a same microprocessor; and operator means for selectively designating a grade of said effect imparting processing, said processor means executing said effect imparting processing on the supplied tone signal in accordance with the grade corresponding to the grade designated by said operator means.

11. A tone processing method for executing effect imparting processing to impart an effect to a supplied tone signal and other processing by shared use of a same microprocessor, said method comprising:

a first step of detecting a tone volume level of the supplied tone signal; and a second step of executing said effect imparting processing on the tone signal when the tone volume level detected in said first step is equal to or higher than a predetermined value, but omitting execution of said effect imparting processing on the tone signal when the tone volume level detected in said first step is lower than the predetermined value.

12. A tone processing method as defined in claim 11 wherein for each time section having a predetermined length, said method executes tone generating processing to generate tone signals in a specific number of tone generating channels corresponding to a specific number of tones to be simultaneously generated and said effect imparting processing on the tone signals generated by said tone generating processing, and wherein said first and second steps are performed for each said time section.

13. A tone processing device comprising:

detecting means for detecting a tone volume level of a supplied tone signal;

processor means for executing effect imparting processing to impart an effect to the supplied tone signal and other processing; and instructing means for instructing said processor means to omit execution of said effect imparting processing when the tone volume level detected by said detecting means is lower than a predetermined value.

14. An effect imparting device comprising:

calculating means for performing various arithmetic operations, said calculation means performing an operation for execution of effect imparting processing to impart a predetermined effect to an audio signal; and control means for discontinuing the execution of the effect imparting processing when supply of the audio signal is stopped continuously for a predetermined time period and resuming the execution of the effect imparting processing when the supply of the audio signal is restarted.

15. A method for executing effect imparting processing to impart an effect to a supplied tone signal and other processing by shared use of a same microprocessor, said method comprising the steps of:

discontinuing the execution of the effect imparting processing when supply of the tone signal is stopped continuously for a predetermined time period; and resuming the execution of the effect imparting processing when the supply of the tone signal is restarted.

16. A machine readable recording medium for use in effect imparting processing to impart an effect to a supplied tone signal and to perform other processing while sharing a microprocessor, said medium containing program instructions executable by said microprocessor to perform the steps of:

controlling a grade of said effect imparting processing, depending on an amount of calculation necessary for said other processing; and executing said effect imparting processing on the supplied tone signal in accordance with the grade controlled in said step of controlling.

17. A machine readable recording medium for use in effect imparting processing to impart an effect to a supplied tone signal and to perform other processing while sharing a microprocessor, said medium containing program instructions executable by said microprocessor to perform the steps of:

selectively designating a grade of said effect imparting processing, wherein the number of calculations associated with said effect imparting processing varies according to the grade such that the number of calculations increases as the grade becomes higher; and executing said effect imparting processing on the supplied tone signal in accordance with the grade corresponding to the grade designated in said step of designating.

18. A machine readable recording medium for use in effect imparting processing to impart an effect to a supplied tone signal and to perform other processing while sharing a microprocessor, said medium containing program instructions executable by said microprocessor to perform the steps of:

detecting a tone volume level of the supplied tone signal; and executing said effect imparting processing on the tone signal when the tone volume level detected in said step of detecting is equal to or higher than a predetermined value, but omitting execution of said effect imparting processing on the tone signal when the tone volume level detected in said step of detecting is lower than the predetermined value.

19. A machine readable recording medium for use in effect imparting processing to impart an effect to a supplied tone signal and to perform other processing while sharing a microprocessor, said medium containing program instructions executable by said microprocessor to perform the steps of:

discontinuing the execution of the effect imparting processing when supply of the tone signal is stopped continuously for a predetermined time period; and resuming the execution of the effect imparting processing when the supply of the tone signal is restarted.

* * * * *